United States Patent [19]

Meredith et al.

[11] Patent Number: 4,927,312

[45] Date of Patent: May 22, 1990

[54] CHIP GATES WITH AIR LOCK

[75] Inventors: Michael D. Meredith; Joseph R. Phillips; Richard O. Laakso; C. Bertil Stromberg, all of Glens Falls, N.Y.

[73] Assignee: Kamyr, Inc., Glens Falls, N.Y.

[21] Appl. No.: 195,890

[22] Filed: May 19, 1988

[51] Int. Cl.[5] ..... B65G 69/00

[52] U.S. Cl. ..... 414/221; 414/786; 414/300; 414/171; 414/167; 414/199; 222/504; 222/188

[58] Field of Search ..... 414/217, 221, 218, 219, 414/786, 220, 292, 199, 200, 299, 300, 301, 157, 171, 167, 182, 586, 207; 222/58, 188, 306, 282, 434, 491, 504, 505, 556, 544, 545; 432/242

[56] References Cited

U.S. PATENT DOCUMENTS

| | | | |
|---|---|---|---|
| 1,007,861 | 11/1911 | Gmeindl, Sr. et al. | 414/167 X |
| 1,618,011 | 2/1927 | Isenberg et al. | 414/271 |
| 2,732,086 | 1/1956 | Schnyder | 414/221 X |
| 3,315,824 | 4/1967 | Kirchhoefer | 414/221 |
| 3,347,741 | 10/1967 | Hutchison | 414/221 X |
| 3,598,257 | 8/1971 | Pantke et al. | 414/171 |
| 4,043,491 | 8/1977 | Johnson et al. | 414/300 X |

FOREIGN PATENT DOCUMENTS

| | | | |
|---|---|---|---|
| 2752488 | 6/1978 | Fed. Rep. of Germany | 414/207 |
| 64578 | 11/1968 | German Democratic Rep. | 222/504 |
| 4829 | 1/1982 | Japan | 414/300 |
| 155167 | 12/1920 | United Kingdom | 414/199 |

*Primary Examiner*—Frank E. Werner
*Attorney, Agent, or Firm*—Nixon & Vanderhye

[57] ABSTRACT

Chip gates are provided adjacent the lower end of an inlet chute to a presteaming vessel for a digester in a pulp production system. The chip gates are operated to maintain a level of chips within the inlet chute sufficient such that the chips preclude egress of noxious odorous gas from the presteaming vessel, while simulataneously the chips are discharged into the vessel.

12 Claims, 3 Drawing Sheets

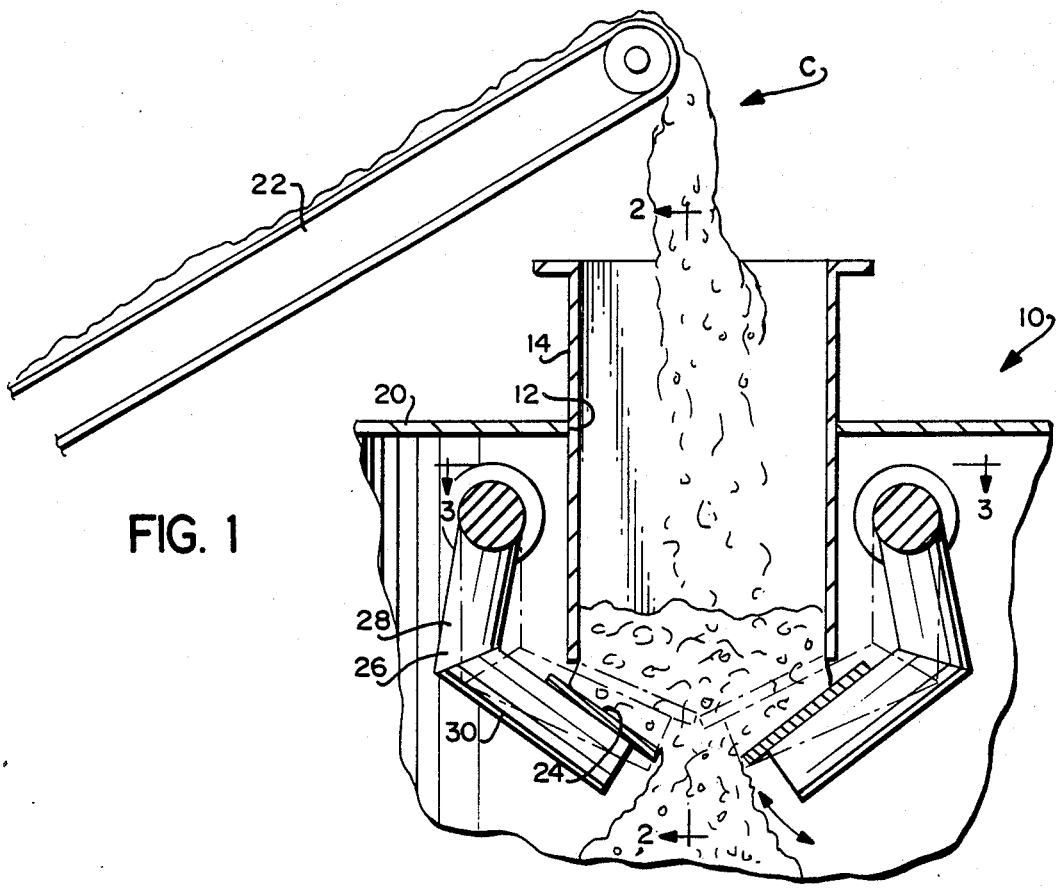
FIG. 1
FIG. 2
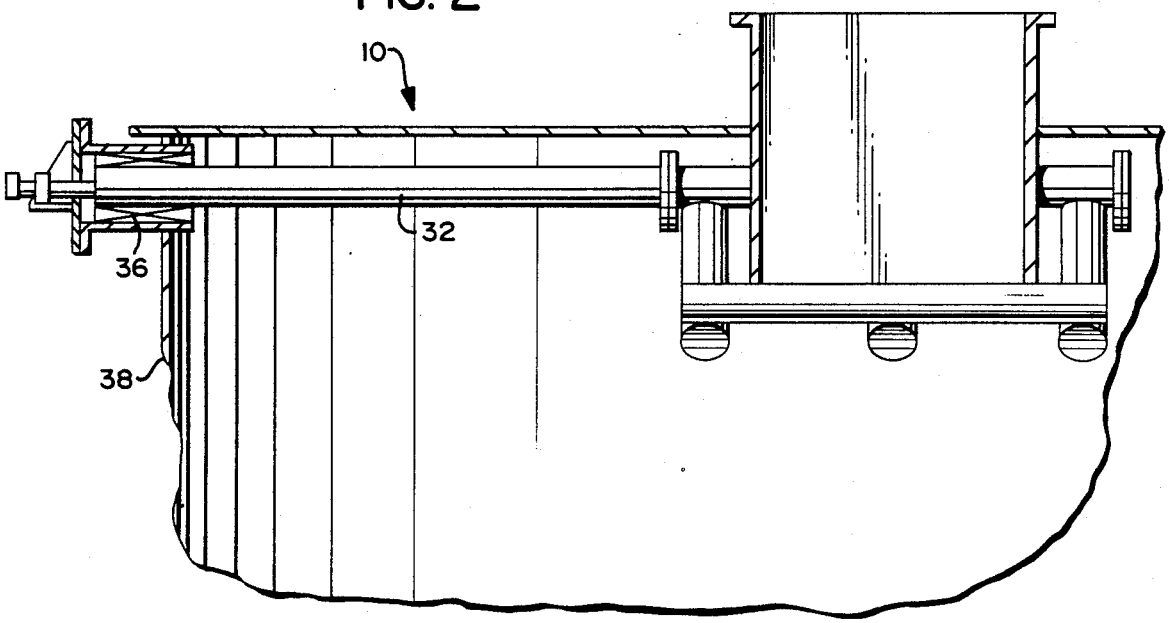

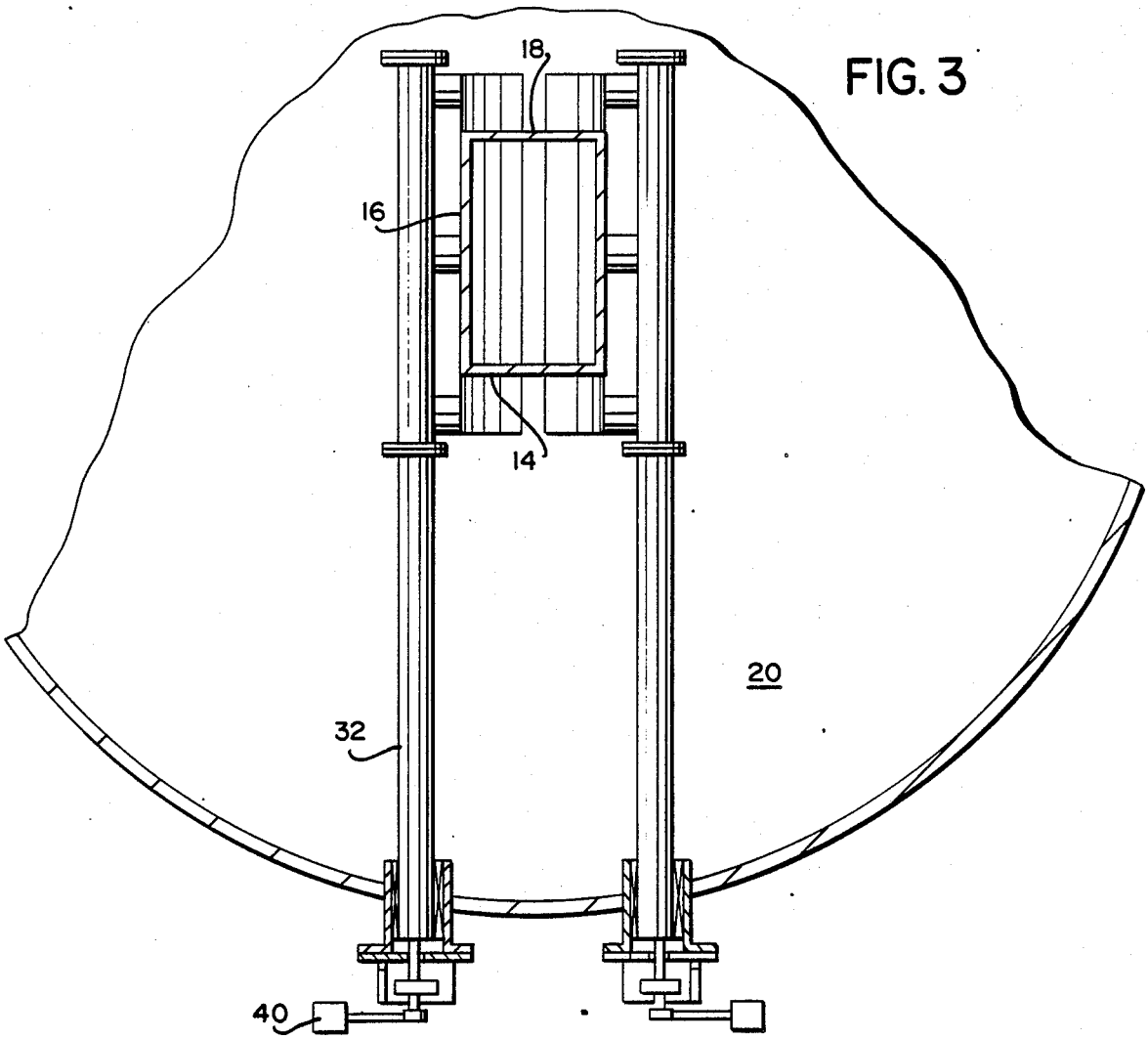
FIG. 3
FIG. 4
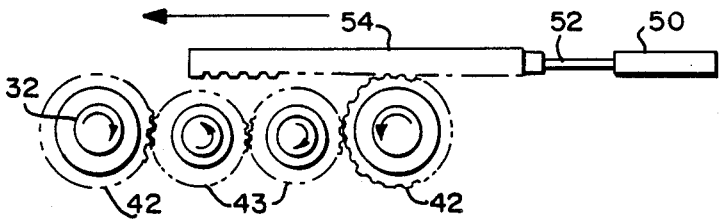

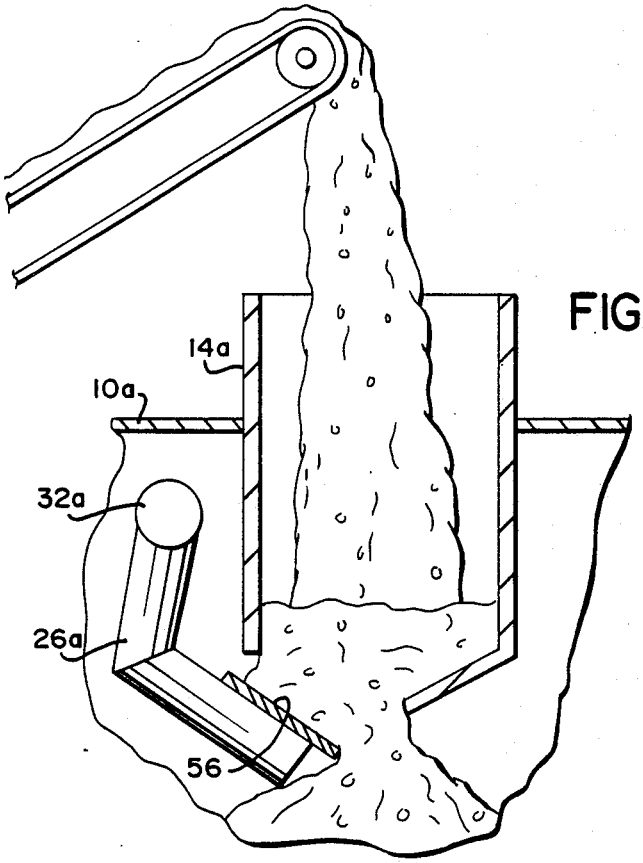
FIG. 5
FIG. 6
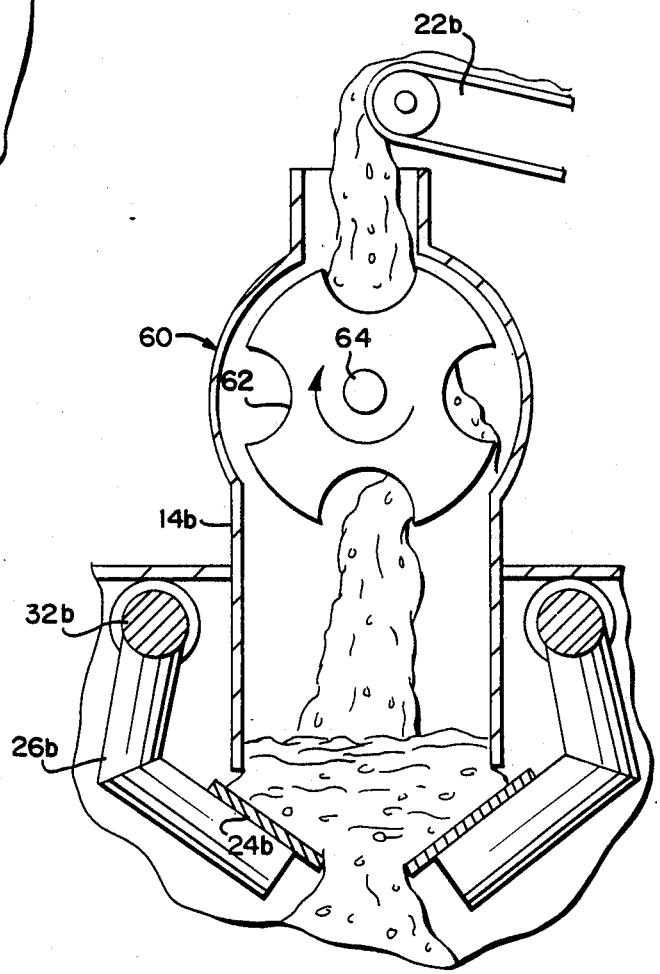
FIG. 7
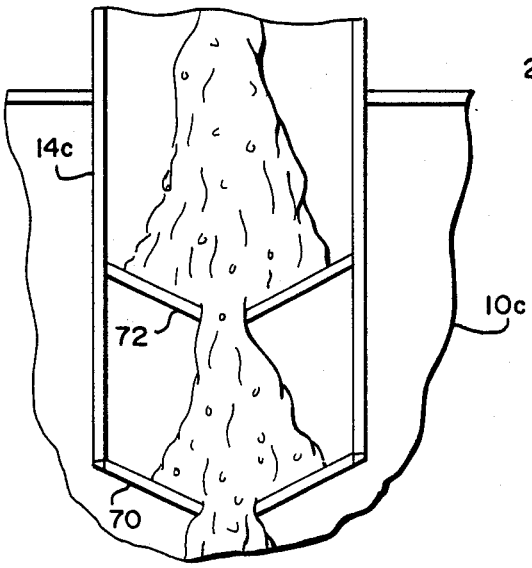

CHIP GATES WITH AIR LOCK

BACKGROUND AND SUMMARY OF THE INVENTION

The present invention relates to apparatus and methods for feeding cellulosic chips into a chip container and simultaneously preventing the escape of gas from the container through the feed opening.

In modern continuous digesters, cellulosic chips and chemicals are fed to a digester where pulping reactions take place necessary to the production of pulp. The chips are usually pretreated in a steaming bin or vessel, typically by dirty steam recovered from the digester. Conventionally, chips are supplied the presteamer for a hopper or directly from a conveyor belt by a low pressure feeder. Such low pressure feeders are generally of a type provided with a star wheel wherein the pockets of the star wheel transport chips from the hopper or conveyor belt into the presteaming vessel. As those familiar with this art will appreciate, the atmosphere within the presteaming vessel is replete with and permeated by odorous sulfur compounds. Because of the potential for environmental and other poblems, it is desirable and almost essential to confine this gas within the pulping system so that any emissions from the system would be marginal or eliminated.

As a specific example of such problem in those systems using low pressure feeders of the star wheel type, the pockets in the star wheel feeder, of course, transport or pump chips into the presteaming vessel. However, those same pockets, when empty of chips, transport gas from the vessel through the inlet to the surrounding environment. That is, the conventional star wheel-type feeder, in operation, also serves as a pump which pumps gas from the vessel into the atmosphere. Notwithstanding efforts to provide feeders of this type with seals, the feeder itself causes undesirable gaseous emissions through this pumping action.

It is important also that the presteaming bin or vessel be maintained under a vacuum pressure. Conventional systems for feeding vessels of this type also admit substantial inlet air. This has required condensers, eductors, fans, piping and the like of substantial capacity in the system. The cost of this equipment is almost directly proportional to the quantity of air flowing into the bin and which must be exhausted via a containment and treatment system. It is therefore desirable to provide a presteaming vessel feeding system which minimizes or eliminates air flow into the vessel such that only a minimum quantity of air is removed from the vessel to maintain it under vacuum pressure.

An additional problem residing with prior feeders for steaming vessels is that the inlets are open substantially at the highest point in the steaming vessel where the noxious odorous gas collects. Thus, any opening of the feed inlet in that area necessarily results in egress of this foul smelling steam or gas from the vessel. It would therefore be highly desirable to locate the chip inlet feed opening at such other location as to preclude escape of this noxious odorous gas or steam.

According to the present invention, there is provided apparatus and methods for feeding cellulosic chips into a vessel, for example a presteaming vessel for use in pulp digesters, and for substantially precluding or minimizing the egress of noxious odorous gas and steam from the presteaming vessel when the chips are fed to the vessel. In accordance with the present invention, there is provided an upstanding, generally cylindrical vessel having a chip feed inlet through its upper surface. In a preferred form of the present invention, the inlet constitutes a rectangular walled tube which extends into the vesel and below its upper surface, terminating at its lower end at a pair of pivoted gates. The gates essentially comprise flat plates which are angled toward one another to provide a central opening through which chips may fall into the vessel. The gates are pivoted about horizontal, spaced parallel axes defined by horizontally extending parallel shafts which straddle the walled inlet within the vessel. The shafts extend outwardly through the walls of the vessel, terminating in counterweights on the opposite sides of the axes from the gates. In this form of the present invention, the gates and counterweights are constructed to pivot the shafts about the axes to equilibrium positions in which, in the absence of chips on the gates, the gates close the inlet.

When operating the feed system of the present invention, the chips are supplied by a conveyor belt to the inlet and deposited onto the gates. The weight of the chips on the gates cause the gates to move away from one another, forming an opening into the vessel. The chips thus fall through the inlet opening into the vessel simultaneously as they are being replenished from the supply conveyor belt. A level of chips on the gates in maintained such that the openings between the gates and between the gates and the margins of the chute are substantially occluded by the chips. In this manner, escape of gas from the vessel through the inlet is substantially prevented by the supply of chips on the gates above the opening as the chips are simultaneously fed into the vessel.

In another embodiment of the present invention, the gates are positively controlled by a fluid actuator. For example, the shafts external of the vessel may be provided with gear wheels which cooperate with a pair of idler gear wheels and a ratchet. The ratchet is under the control of a fluid-actuated cylinder. By actuating the cylinder and hence linearly displacing the ratchet, the shafts and, hence, gates, are rotated to open or close the inlet.

In another preferred form of the present invention, the walled inlet extends into and below the upper surface of the vessel. Consequently, the noxious odorous gas or steam which collects in the vessel collects substantially above the lower end of the inlet. Thus, the opening of the inlet into the vessel is at an elevation below the level of steam or gas in the vessel and such steam or gas would therefore not escape into the atmosphere through the chip feed opening.

In a still further preferred form of the present invention, the inlet may be provided with a feeder, for example of the star wheel type. The feeder may be located in the inlet upstream of the gates.

In a still further form of the present invention, two pairs of serially arranged gates are provided in the inlet chute. As a result, noxious, odorous gas or steam which may escape past the first gate closure is trapped by the second gate.

Therefore, in accordance with a preferred embodiment of the present invention, there is provided apparatus for feeding cellulosic chips comprising a vessel for receiving the chips and means carried by the vessel defining an inlet to the vessel for supplying chips thereto while simultaneously substantially precluding escape of gas from the container through the opening including means for supporting the chips in said inlet in positions substantially precluding escape of gas through the inlet while the chips are simultaneously supplied to the vessel.

In accordance with another preferred embodiment of the present invention, there is provided a method for feeding cellulosic chips into a vessel having an inlet and substantially simultaneously curtailing escape of odorous gas from the vessel through the inlet, comprising the steps of flowing the chips through the inlet into the vessel and simultaneously maintaining a mass of chips in the inlet at a predetermined level sufficient to occlude the inlet thereby to substantially preclude escape of gas from the vessel through the inlet.

Accordingly, it is a primary object of the present invention to provide novel and improved apparatus for feeding cellulosic chips into a vessel and simultaneously precluding or minimizing the escape of noxious odorous gas from the vessel.

These and further objects and advantages of the present invention will become more apparent upon reference to the following specification, appended claims and drawings.

BRIEF DESCRIPTION OF THE DRAWING FIGURES

FIG. 1 is a fragmentary cross-sectional view of an inlet to a steaming vessel illustrating chip gates constructed in accordance with the present invention;

FIG. 2 is a cross-sectional view thereof taken generally about on lines 2—2 in FIG. 1;

FIG. 3 is a cross-sectional view thereof taken generally about on lines 3—3 in FIG. 1;

FIG. 4 is a schematic illustration of another form of the present invention using a fluid-actuated cylinder to operate the chip gates; and FIGS. 5–7 are views similar to FIG. 1 illustrating still further embodiments of the present invention.

DETAILED DESCRIPTION OF THE DRAWING FIGURES

Reference will now be made in detail to the present preferred embodiment of the invention, an example of which is illustrated in the accompanying drawings.

Referring now to FIG. 1, there is illustrated a steaming vessel, generally designated 10, forming part of a digester system for the production of pulp. Steaming vessel 10 includes an inlet opening 12 through its upper surface, into which is received a chute 14 for receiving chips and depositing the chips within vessel 10. Chute 14, as illustrated in FIG. 3, is generally rectangular in configuration, having side and end walls 16 and 18, respectively, and which walls extend both above and below the upper wall 20 of presteaming vessel 10. In FIG. 1, there is illustrated a conveyor 22 for conveying chips, generally designated C, upwardly to an elevation above inlet chute 14 whereby the chips may free-fall into the chute for disposition in the steaming vessel 10.

In accordance with the present invention, a pair of chip gates 24 are disposed adjacent the outlet end of inlet chute 14 and incline downwardly from the lower margins of chip inlet chute 14 toward one another terminating, in the closed condition of the chip gates, at an apex. Chip gates 24 comprise essentially planar sheets disposed and secured on the lower ends of a plurality of horizontally spaced support members 26. Each support member 26 includes a generally vertically disposed, downwardly extending portion 28 and an inwardly inclined laterally extending portion 30 underlying a chip gate plate 24. The upper ends of the vertical portions of the support members 26 are secured to horizontal shafts 32. The ends of the shafts 32 within vessel 10 are suitably supported from the vessel 10 interiorly thereof by means not shown. The opposite ends of the shafts 32 each extend through a bearing 36 mounted in the vertical wall 38 of vessel 10. The gates 24 are therefore mounted for pivotal movement about generally spaced parallel horizontal axes coincident with the axes of shafts 32 between positions where the plates meet at an apex, closing the inlet through chute 14 into vessel 10 and a chute inlet open position, with the plates pivoted away from one another and from the lower margins of the chute, enabling chips to fall through inlet 14 into vessel 10.

In accordance with a preferred embodiment of the present invention, the weight of the chips on plates 24 determines the extent to which the plates open or close the inlet opening to vessel 10. Accordingly, counterweights 40, illustrated in FIGS. 3, are provided on the ends of shafts 32. The counterweights 40 are positioned to provide for pivotal movement of the shafts about their axes in a direction tending to close the inlet opening through inlet chute 14. However, the weight of the chips on chip plates 24 tends to pivot the plates and, hence, the shafts 32 in the opposite direction, tending to open the inlet to the vessel.

In using the chip gates of the present invention, the gates are normally in a closed condition in the absence of chips in the inlet chute 14. As the chips fall into the inlet chute 14, they accumulate on the gates until a predetermined weight of the chips causes the plates to pivot in a direction away from one another, opening the inlet to the vessel. Upon opening the inlet, the chips drop freely into vessel 10. The counterweights, however, are weighted such that a buildup of chips above chip plates 24 are within inlet chute 14 is necessary before a substantial flow of chips enters vessel 10. That is, the counterweights are provided such that a depth of chips is provided in inlet chute 14 above chip plates 24 and the lower margins of the chute sufficient to provide a substantial air seal through the inlet chute 14 while simultaneously affording a steady flow of chips into the vessel. Thus, the depth of chips in the inlet chute 14 determines the degree of opening of the chute in such manner that an equilibrium is obtained between the chip input to the inlet chute 14 and the chip outlet from inlet chute 14 into vessel 10.

Referring now to the embodiment hereof illustrated in FIG. 4, instead of using counterweights 40, the shafts may be driven between open, closed and intermediate positions by a fluid-actuated cylinder. Particularly, shafts 32 are provided with gears 42 on the ends thereof outside vessel 10. A pair of idler gears 43 mesh with and between gears 42. A fluid cylinder, i.e., an air-actuated cylinder 50, has a piston rod 52 in driving relation to a rack 54 geared to one of gears 42. By actuation of the fluid cylinder, the shafts 32 may be rotated in unison and in opposite directions to open, close or change the degree of opening of the chip gates 24.

Referring now to the embodiment hereof illustrated in FIG. 5, there is provided an inlet chute 14*a* disposed in the top of vessel 10*a*. In this form, rather than having a pair of gates or plates, a single gate 56 is provided. The gate is mounted on support elements 26*a* similarly as one of the gates is mounted on support elements 26 in the embodiment of FIG. 1. Element 26*a* is supported by a pivoted shaft 32a. Consequently, counterweights provided on the end of shaft 32a or a suitable drive means, such as the fluid-actuated cylinder 50 illustrated in the embodiment of FIG. 4, may be provided to rotate shaft 32a and hence pivot chip gate 56 between open and closed positions. As in the prior embodiment, sufficient buildup of chips occurs within the chute before an equilibrium condition obtains enabling both continuous flow of chips into the vessel and a simultaneous air seal in the inlet.

In FIG. 6, there is illustrated a combination of a prior conventional low pressure feeder, generally designated 60, disposed at the inlet to inlet chute 14b and one or more chip gates 24b, disposed adjacent the bottom terminus of inlet 14b in accordance with either of the embodiments of FIG. 1 or 5. The feeder 60 may comprise a conventional star wheel having pockets 62 at circumferentially spaced positions thereabout and rotatable about an axis 64. Consequently, chips supplied by the conveyor 22b to the opening at the top of inlet 14b are pumped by the feeder 60 to the lower end of the inlet chute. Thus, the air lock provided by the chips accumulating in the lower end of the chute as they are discharged into the vessel 10b form an air lock as in the previous embodiment, with the chips being positively fed thereto by the feeder 60.

In the embodiment of the present invention illustrated in FIG. 7, a pair of superposed chip gates 70 and 72 may be provided in the inlet chute 14c. In this form, the chip gates of each pair thereof are pivoted adjacent their outer edges on shafts, not shown, which extend, as in the previous embodiments, laterally outwardly of the vessel 10c. The shafts, as well as the gates, are pivotally mounted to the inlet chute side walls. Consequently, the pivoting action of the pairs of superposed chip gates may be similar to the pivoting action shown in FIGS. 1 and 4, i.e., under the control of the counterweight or fluid-actuated cylinders, respectively. In this latter embodiment, it will be appreciated that a double air lock is provided. That is, the chip accumulation above each of the pairs of superposed gates is such as to prevent egress of air from vessel 10c sequentially through the chip gates while chips are simultaneously and continuously fed vessel 10c.

Accordingly, it will be appreciated that the objects of the present invention are fully accomplished in that there has been provided a chip gate for discharging or metering chips into a presteaming vessel in a digester system for the production of pulp wherein the noxious odorous gases generated in the system and in the presteaming vessel are substantially precluded from egress to the atmosphere. This is accomplished primarily through the sealing action of the aggregate of chips deposited on the chip gates when the chip gates lie in their open positions substantially continuously and simultaneously feeding chips to the presteaming vessel.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for feeding cellulosic chips, comprising:

a vessel, having top, bottom and side walls, for receiving the chips;

means carried by said vessel defining an inlet in the top wall of said vessel for continuously supplying chips thereto while simultaneously substantially precluding escape of gas from said vessel through said inlet including an inlet opening and a gate mounted in a single plane to support the chips and movable in said opening for varying the size of said opening, said gate having a surface and being movable into a position to support the chips in said opening in positions overlying said surface and overlying and occluding said opening to substantially preclude escape of gas through said inlet opening by the downward mass/flow of the chips while the chips are simultaneously supplied to the vessel through said inlet opening when the gate surface is in a downwardly directed supplying position; and means responsive to the weight of the chips on said gate for varying the size of said opening while the chips are supplied through the opening while simultaneously maintaining a downward mass/flow of chips sufficient to preclude the escape of gas from the vessel through said inlet opening.

2. Apparatus according to claim 1 including means for moving said gate in response to the weight of the chips on said support surface.

3. Apparatus according to claim 2 including means mounting said gate for pivotal movement about an axis, said gate lying on one side of said axis tending to pivot said gate in one direction and a counterbalancing weight carried by said gate tending to pivot said gate in the opposite direction whereby the gate is maintained in equilibrium.

4. Apparatus according to claim 1 wherein said inlet defining means includes an inlet opening and a pair of gates movable to vary the size of the opening, said supporting means including surfaces of said gates.

5. Apparatus according to claim 4 including means for mounting said gates for movement about spaced parallel axes on opposite sides of said opening, and means for moving said gates about said axes to vary the size of said opening.

6. Apparatus according to claim 1 wherein said opening defining means includes a walled inlet for said vessel, a feeder for positively displacing chips into the walled inlet in advance of said support means.

7. Apparatus according to claim 1 wherein said inlet defining means includes a walled inlet chute for said vessel, a second means for supporting the chips in said inlet chute in advance of said first mentioned chip supporting means in positions substantially precluding escape of gas past said second means while the chips are simultaneously supplied the first chip supporting means.

8. Apparatus according to claim 1 wherein said inlet defining means includes a walled inlet chute, said vessel having an upper wall defining the top portion of said vessel, said walled inlet chute extending through said upper vessel wall to terminate at an elevation in said vessel below said upper vessel wall portion.

9. A method for feeding cellulosic chips into a vessel having top, bottom and side walls, an inlet opening in said top wall and a movable gate therefor and substantially simultaneously curtailing escape of odorous gas from the vessel through the inlet opening, said gate having a planar gate surface for receiving the chips, comprising the steps of:

flowing the chips through the inlet opening into the vessel, including flowing the chips onto said gate surface;

supporting the chips on the gate surface;

simultaneously with the flow of chips onto said gate surface, maintaining a mass of the chips in the inlet opening on said gate surface and at a predetermined level in said opening sufficient for the chips to occlude said inlet opening to substantially preclude escape of gas from the vessel through the inlet opening; and moving the gate to vary the extent of said inlet opening in response to the weight of the chips on said gate surface whereby the chips simultaneously flow through said opening into the vessel and substantially prevent escape of gas from the vessel through said inlet opening.

10. A method according to claim 9 wherein the vessel has an upper wall defining the top portion of said vessel and further including the steps of locating said inlet opening to said vessel at an elevation below the elevation of said upper wall portion.

11. A method for feeding cellulosic chips into a vessel having top, bottom and side walls, an inlet opening in said top wall and a movable gate therefor and substantially simultaneously while feeding chips into the vessel curtailing escape of odorous gas from the vessel through the inlet opening, said gate having a planar gate surface for receiving the chips, comprising the steps of:

flowing the chips through the inlet opening into the vessel, including flowing the chips onto said gate surface;

supporting the chips on the gate surface;

simultaneously maintaining the mass of chips in the inlet opening on said gate surface at a predetermined level sufficient for the chips to occlude said inlet opening to substantially preclude escape of gas from the vessel through the inlet opening; and actuating a fluid cylinder to move said gate and vary the extent of said inlet opening.

12. A method according to claim 11 wherein the vessel has an upper wall defining the top portion of said vessel and further including the steps of locating said inlet opening to said vessel at an elevation below the elevation of said upper wall portion.

* * * * *